United States Patent [19]

Chesnut

[11] 4,205,596

[45] Jun. 3, 1980

[54] ROTARY DIE CUTTING DEVICE

[75] Inventor: W. Richard Chesnut, West Caldwell, N.J.

[73] Assignee: W. R. Chestnut Engineering, Inc., Fairfield, N.J.

[21] Appl. No.: 905,740

[22] Filed: May 15, 1978

[51] Int. Cl.[2] ..... B31B 1/16; B31B 1/25

[52] U.S. Cl. ..... 93/58.2 R; 83/344; 83/503; 100/170

[58] Field of Search ..... 83/344, 345, 343, 503; 100/170; 93/58.2 R, 58.2 F

[56] References Cited

U.S. PATENT DOCUMENTS

| | | | |
|---|---|---|---|
| 2,258,816 | 10/1941 | Shields | 83/344 X |
| 3,448,684 | 6/1969 | Cardinet et al. | 83/344 X |
| 3,461,767 | 8/1969 | Stubbins | 83/344 |
| 3,518,912 | 7/1970 | Winstead | 83/344 |
| 3,570,348 | 3/1971 | Hallden | 83/344 X |
| 3,606,811 | 9/1971 | Hallden | 83/344 X |
| 3,897,705 | 8/1975 | Filleau et al. | 83/344 X |

*Primary Examiner*—Frank T. Yost

*Attorney, Agent, or Firm*—Carella, Bain, Gilfillan & Rhodes

[57] ABSTRACT

Rotary die cutting apparatus having novel structure for achieving registration of the die roller and base roller in terms of axis parallelism and rotational positioning is disclosed in the context of apparatus for cutting and scoring cardboard in the manufacture of boxes.

6 Claims, 7 Drawing Figures

ROTARY DIE CUTTING DEVICE

BACKGROUND OF THE INVENTION

This invention relates to rotary die cutting devices. More specifically, this invention relates to rotary die cutting apparatus for use to cut and/or score a web of material such as cardboard utilized in commercial boxes and the like.

The manufacture of many products such as cardboard boxes, paper products and the like involves the subjection of the raw material to a plurality of operating stations with the material being passed through the stations in continuous moving web form.

The manufacture of commercial cardboard cartons and similar products often involves passing a web of material through a gravure press consisting of a plurality of color stations. In this manner the web is provided with a multi-color print design and may also be provided with a varnish overcoating. Once the decorative functions have been completed the web material is passed through a die cutting machine so as to permit the application of desired die cuts and creases which are utilized in the assembly of the final product. A station may also be provided beyond the cutting station to strip out waste which may occur between the carton blanks and thereafter to deliver the blanks in shingled streams onto a delivery belt.

Two basic types of in-line die cutting apparatus have become known in the prior art. Conventional means to perform such in-line die cutting have comprised a reciprocating type platen which is designed to run in synchronization with the printing. Thus, between the last gravure station and the die cutting station there is provided an intermittent feeding station which permits momentary stopping of the web material so that the die platen may be closed to effect the desired cutting and creasing. Upon the completion of this operation the web is then accelerated to faster than the speed of operation of the web through the gravure stations so as to establish and maintain an average web velocity through all stations.

In addition to the fact that such reciprocating platen type die cutting apparatus require additional equipment for operation such as the accelerating devices previously referred to and devices such as accumulators which accommodate the acceleration, the reciprocal machines themselves have the disadvantage of being sensitive to misregistration as a result of the intermittent feeding. Further, the forces involved in acceleration limit the speed of the overall line because of the reciprocal dynamics experienced.

In order to avoid the problems of reciprocal misregistration, speed limitation and the requirement for additional capital expenditures, operational costs and maintenance attendant to the provision of auxillary equipment for use in operating reciprocal die cutting apparatus, the industry has resorted to the use of rotary die cutting apparatus.

A rotary die cutting apparatus eliminates the above stated problems because it comprises the utilization of a pair of rollers having grooves and lands formed on the surfaces thereof to form the desired cuts and scores. Further, by matching the surface rotational speed of the rollers to the desired speed of advance of the web through the remaining stations of the production line there is no necessity for intermittent operation, accumulators or other such auxillary equipment.

Because of the expense involved in producing rotary dies, such rotary die cutters in the past have been limited in their use to operations which involve extensive runs thus making relatively small the cost of the die cutting rollers per workpiece.

The advantages of rotary die cutting apparatus have been recognized and those skilled in these arts have attempted to reduce the cost per workpiece and thus broaden their utilization. Thus, typical dies for forming severence lines and methods for forming such severence lines are shown in three patents to Downie, U.S. Pat. No. 3,170,342, U.S. Pat. No. 3,244,335 and U.S. Pat. No. 3,142,233. Further, an advance in the manner of utilizing die sheets in conjunction with die rollers and in particular a structure for locking such die sheets in place to maintain a continuous die cutting surface as desired in the subject matter of my co-pending application, Ser. No. 860,691, filed Dec. 15, 1977, entitled ROTARY DIE LOCK STRUCTURE.

Although those skilled in the art have dealt with rotary die cutting apparatus and the problem of eliminating the necessity for intermittent advance of a web, two additional problems have been experienced. Initially, difficulties have occurred in maintaining running registration also known as rotary registration. Additionally, difficulties have been experienced in maintaining axis parallelism during operation.

For purposes of explanation, the term "running" or "rotary" registration means a registration as to the relative angular positions of the mating rollers of die cutting apparatus. Axis parallelism relates to the maintenance of a desired constant spacing between the surfaces of the rollers during operation so that proper relationship is established between the lands, cutting edges, rules and grooves utilized to form the desired cuts and grooves.

Various approaches have been taken with respect to establishing rotary registration. Thus, some apparatus permit adjustment of rotary registration by providing structure for effective disconnect of the roller from the roller drive mechanism so as to permit rotation of the roller independently therefrom. This approach, however, is disadvantageous because it requires termination of operation as well as at least partial disassembly of the apparatus in order to achieve the desired registration.

A second approach to achieving rotary registration has been through the use of plural gears. More specifically, through the use of a plurality of gears in the nature of planetary gearing, both the rotational reversal of direction as well as adjustment to rotating registry have been achievable. This approach, however, because of the plurality of gears involved, has been unsatisfactory where rotary registration is a critical factor in the production process. As will be recognized by those skilled in these arts, all gearing systems, by virtue of nothing more than acceptable tolerances, have a degree of play or "back lash". Such back lash causes an inherent registration problem. Thus, where a plurality of gears are utilized, the back lash problem may become cumulative thus causing such a degree of play as between the rollers of the die cutting apparatus that acceptable rotational or running registration becomes impossible. More specifically the degree of error introduced by what are otherwise acceptable tolerances creates a misregistration which is unacceptable and incapable of correction.

The second problem presented by known rotary cutting apparatus has been the ability to maintain axis parallelism, or, as it is sometimes known in the trade "impression" during operation. Axis parallelism at a particular desired spacing provides for the desired edge-to-edge, surface-to-surface or side-by-side relationship as among the lands, grooves, rules and other surfaces on the surface of the respective rotary die cutting rollers. In prior art structures, the operation of the apparatus and forces created thereby have tended to cause separation of the roller surfaces often at one end or the other depending upon where the highest cutting forces are generated, as a result of which the parallelism of the axes of the rollers is destroyed. With such parallelism destroyed the die rollers are no longer capable of adequately cutting or grooving and adjustment must be required.

An additional disadvantage of prior art structures has been that in order to change from one size die cutting roller to another in terms of roller circumference, prior art systems required the use of substitute circular pitch type and pitch line gearing. The substitution of the different gearing because of the change in circumference of the rollers is caused by the displacement of the axes of rotation. Needless to say the necessity of changing gearing when it is desired to change the size of rollers being accommodated greatly complicates the procedure and expense and is highly undesirable.

SUMMARY OF THE INVENTION

It is an object of the present invention, therefore, to provide a rotary die cutting apparatus which may be operated at a web advance speed which is consistent with the web advance speed of an overall production line.

Another object of the present invention to provide a rotary die cutting apparatus wherein rotary or running registration can be adjusted without the necessity for disassembly of the apparatus and without the necessity for the use of a plurality of gears.

Yet another object of the present invention is to provide a rotary die cutting apparatus wherein fine adjustments in rotary or running registration can be made during the operation of the apparatus i.e. without interruption of a production run.

Still a further object of the present invention is to provide a rotary die cutting apparatus wherein fine adjustments may be made in axis parallelism and wherein the structure of the apparatus is such as to permit maintenance of axis parallelism during ordinary operation of the apparatus.

An additional object of the present invention is to provide a rotary die cutting apparatus which is relatively simple to construct, economical to construct and operate and which is adaptable for use with web-type production equipment without the necessity for auxiliary equipment.

These objects and others not enumerated are achieved by the rotary die apparatus according to the present invention, one embodiment of which may include a first roller rotatably mounted in a support, a second roller also rotatably mounted in the support means for imparting rotation to the first roller and second roller including a first drive for imparting rotation to the first roller, a second drive for imparting rotation to the second roller and means for imparting rotation to the drives, wherein the axis of rotation of the second drive is displaced from the axis of rotation of the second roller and further including means for connecting the second drive to the second roller for transmitting rotation from the second drive to the second roller and still including means for mounting the second drive such that the second drive is displaceable along an arc the center of which is the axis of rotation of the first drive.

BRIEF DESCRIPTION OF THE DRAWINGS

A more complete understanding of the present invention may be had from the following detailed description thereof particularly when considered in the light of the accompanying drawings wherein.

DETAILED DESCRIPTION

Figure 1:
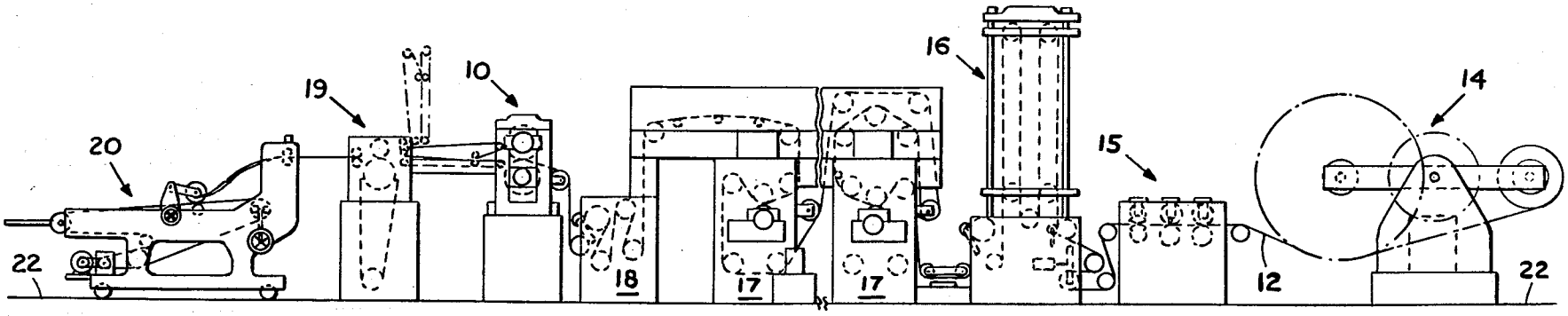
FIG. 1 is a schematic view of a carton production line in which is utilized a rotary die cutting apparatus according to the present invention.

Referring therefore to FIG. 1, a rotary die cutter apparatus structured in accordance with the present invention is shown and designated generally by the reference numeral 10.

Apparatus 10 is shown in use as a part of a multi-color gravure press line for the manufacture of commercial cardboard boxes. As will be recognized by those skilled in these arts the press line includes a turnover roll stand 14 for mounting and supplying operating and fresh webs of material to be printed, an automatic butt splicer unit 15, a feed roller and festoon tower 16, a plurality gravure printing stations 17, a pull unit 18, a universal stripping unit 19 and a cascade type delivery unit 20.

Considering briefly the operation of the line, a continuous web 12 of material to be printed is fed from one of the rolls of web material provided on turnover roll stand 14. As the active of the two webs expires, the leading end of the fresh web is spliced to the trailing end of the expiring web in automatic splicer 15 so that the printing stations of the apparatus are provided with a continuous web of material.

As the web 12 of material is discharged from the splicer 15, it is received by and passed through feed unit and festoon tower 16. The food unit and festoon tower 16 insure that web 12 is passed into the printing stations 17 at the desired constant velocity and that the web material being fed is flat and configured to properly enter the printing stations.

Web 12 is then passed through printing stations 17 to cause the printing thereon of the desired colors in the desired patterns. As the web 12 is discharged from the printing stations 17 it passes into pull unit 18 which provides the propelling force to the web as it is passed through the line.

Upon discharge of web 12 from pull unit 18, the web is passed through rotary die cutter 10 wherein it is cut and scored as will be discussed below in detail. Thereafter the web 12 is passed through universal stripping unit 19 wherein excess material and scrap is stripped from the basic web. Finally the cut, scored and stripped web is passed into the cascade delivery unit 20 wherein the individual cartons are separated and stacked in a suitable cascade fashion to be appropriate for packaging, boxing and shipping.

It is evident from the foregoing and well recognized by those having skill in these arts, that any interruption to the operation of the line requires an involved start-up procedure and is both time consuming and expensive. A rotary die cutter which minimizes such interruptions is extremely valuable and an asset to production efficiency. Rotary die cutter 10 is such a cutter.

Figure 3:
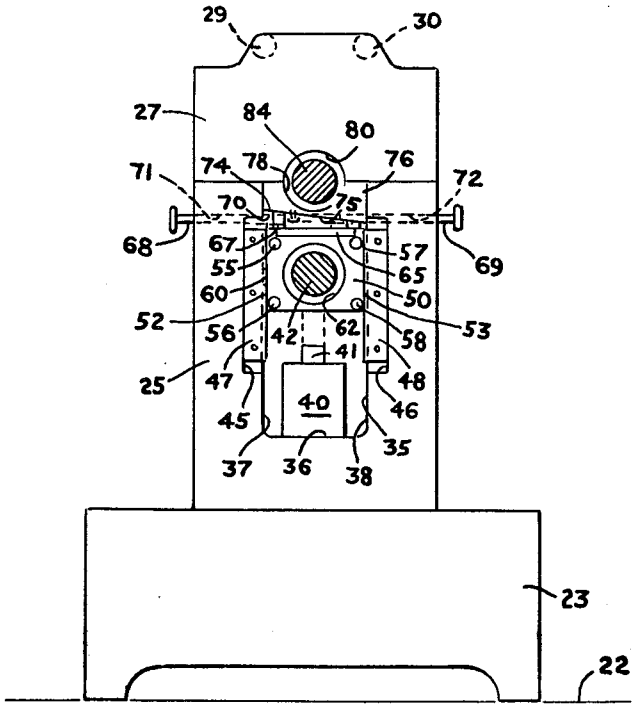
FIG. 3 is a side elevational view, partly in section, through the plane 3—3 of FIG. 2.
Figure 2:
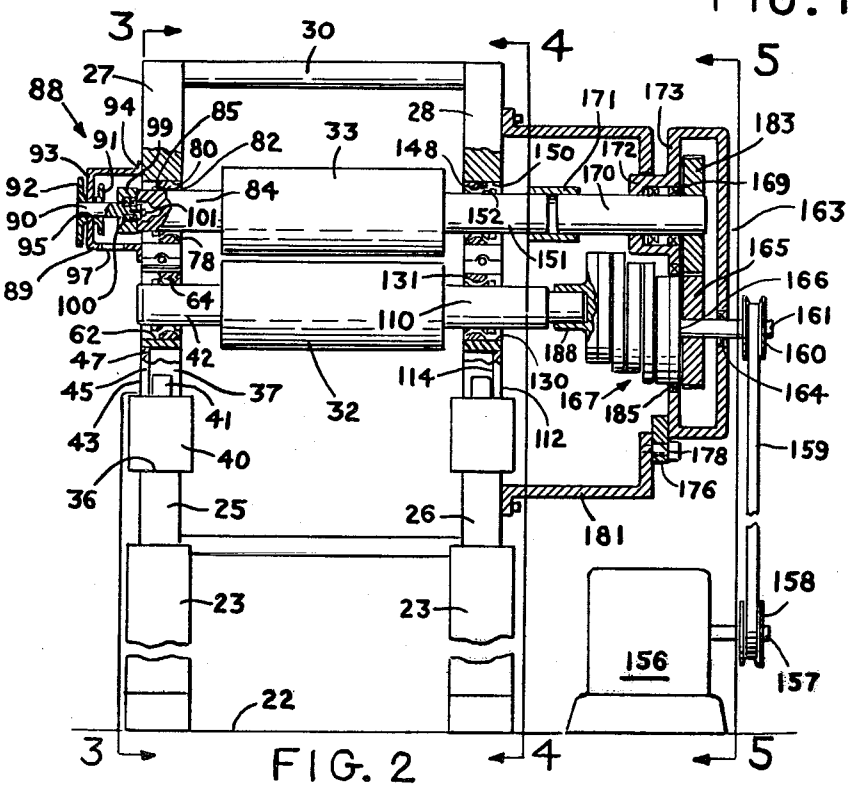
FIG. 2 is a side elevational view, partly in cross-section, of the rotary die cutting apparatus structured in accordance with the teachings of the present invention.
Figure 4:
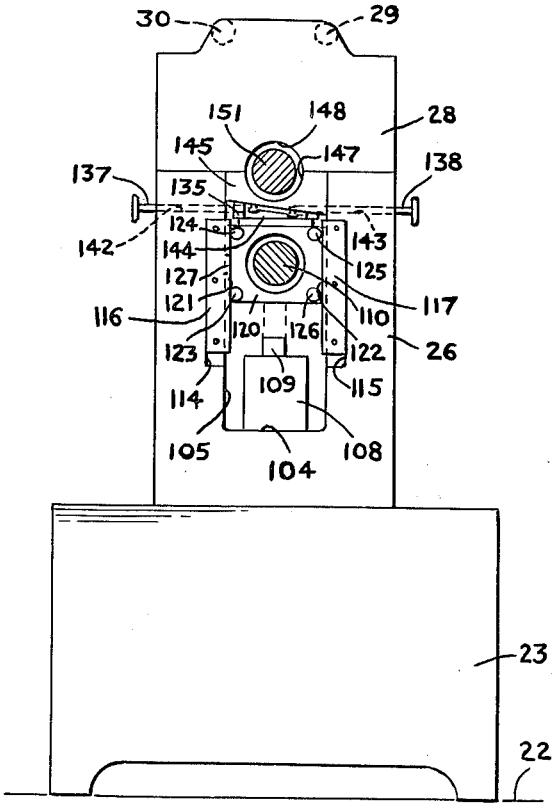
FIG. 4 is a side elevational view, partly in section, through the plane 4—4 of FIG. 2.

Considering, therefore the details of the structure of cutter 10 and with particular reference to FIGS. 2, 3 and 4, rotary die cutter 10 can be seen to be supported on floor 22 through a base 23. Rigidly secured to and supported by base 23 are a first lower frame 25 and a second lower frame member 26. Rigidly secured to and supported by first lower frame member 25 is a first upper frame member 27. Similarly, rigidly secured to and supported by second lower frame member 26 is a second upper frame member 28.

Rigidly secured to and disposed between first and second upper frame members 27, 28 are a pair of transversely extending parallel support bars 29 and 30. Support bars 29 and 30 cooperate with frame members 25, 26, 27, and 28 and base 23 to define a rigid support structure for the operating elements of apparatus 10. More specifically, the various frame members, support bars and the base cooperate to provide a rigid support structure for base rollers 32 and die roller 33 as well as their associated structure, all as discussed below in detail.

Referring therefore to FIGS. 2 and 3, it can be seen that first lower frame member 25 is a generally U-shaped member having a generally vertically extending channel 35 formed therein. Channel 35 has a base surface 36 and opposed side surfaces 37, 38, the side surfaces extending upwardly from base surface 36 through the remaining height of first lower frame member 25.

Rigidly secured to and supported on base surface 36 of channel 35 is a fluid motor 40 having a vertically extensible piston 41 extending reciprocably therefrom. In the embodiment shown, piston 41 is displaceable through a distance "A" (FIG. 3) to engage and exert an upwardly directed force upon the apparatus supporting one end of the shaft of base roller 32. In this regard, fluid motor 40 is a hydraulic cylinder which may be any one of the many which are known and generally available in the art.

The outer surface 43 of first lower frame member 25 is relieved adjacent side surfaces 37 and 38 to define a pair of generally vertically extending channels 45 and 46. Rigidly secured within channels 45 and 46 such as by machine screws and tapped bores are a pair of track elements 47, 48 respectively. Track elements 47, 48 cooperate to define a path for the controlled vertical displacement of the apparatus which supports shaft 42.

Shaft 42 is rotatably supported within a bearing housing 50. More specifically bearing housing 50 comprises a generally rectangular member which is disposed within channel 35 and which extends between side surfaces 37 and 38. The outer side edges of housing 50 are relieved to define vertically extending channels 52,53 such that track elements 47 and 48 are slidably received therein. Further, the upper and lower outer corners of housing 50 are relieved adjacent channels 52,53 to permit the recessed mounting therein of cam bearings 55, 56, 57 and 58. The surfaces of cam bearings 55 and 56 engage the inner edge of track element 47. Similarly, the surfaces of cam bearings 57 and 58 engage the inner edge of track element 48. The utilization of cam bearings 55, 56, 57 and 58 in cooperation with their respective track elements permits the transverse positioning of housing 50 within channel 35 and therewith, of course, shaft 42.

Rotatably disposed on the outer edge of housing 50 is a cam bearing 60. The surface of cam bearing 60 engages the outer surface of track element 47 to position housing 50 within channel 35 in a direction of the axis of shaft 42. Further, there is provided a second cam bearing (not shown) which is aligned with but opposed to cam bearing 60 and which second cam bearing engages the opposite surface of track element 47 from cam bearing 60. Thus cam bearing 60 and the second cam bearing cooperate to rigidly position housing 50 within channel 35. Further, the various cam bearings associated with housing 50, while cooperating to position housing 50 within channel 35, also permit the free vertical movement of housing 50 within channel 35.

Extending through housing 50 is a bore 62 in which is received a bearing 64. The outer race of bearing 64 is rigidly positioned in housing 50 at bore 62 and the inner race of bearing 64 is rigidly secured to shaft 42 for rotation therewith. Thus shaft 42 is rigidly positioned with respect to transverse axial movement.

As best may be seen in FIG. 3, there is rigidly secured to the upper surface of housing 50 a spacer plate 65. Spacer plate 65 is utilized to provide a rough positioning between the axes of rollers 32 and 33 and may be selected from a group of spacers which may be sized based upon the desired axial relationship of the rollers.

The upper surface of spacer plate 65 is adapted to engage the lower surface of a wedge element 67. Wedge element 67 is displaceable transversely through the operation of a pair of opposed elongated screws 68 and 69. More specifically, screws 68 and 69 are in abuttng engagement with the side surfaces of wedge element 67. Each of screws 68 and 69 is provided with an operating handle, the rotation of which causes rotation of screws 68 and 69. Further, screws 68 and 69 extend through tapped bores 71 and 72 formed in the upper end of first lower frame member 25. Thus, the cooperative rotation of screws 68 and 69 causes transverse displacement of wedge element 67 and therewith, as is discussed below in detail, the vertical displacement of wedge element 67.

The upper surface 74 of wedge element 67 is disposed at an angle which corresponds to the angle formed on the lower surface 75 of a bearing support element 76. More specifically, there is provided at the upper end of channel 35 and extending between side surfaces 37 and 38 of first lower frame member 25, a bearing support element 76 which is rigidly secured to first upper frame member 27 such as by machine screws (not shown).

Formed in the upper surface of bearing support element 76 is a semi-circular channel 78. Channel 78 cooperates with a semi-circular channel 80 formed in the lower surface of first upper frame member 27 to define a bore within which to receive a bearing 82. The inner race of bearing 82 is rigidly secured to a shaft 84 of die roller 33 e.g. by a lock nut 85.

The outer race of bearing 82 is slidably received within bore formed by the cooperation of semi-circular channels 78 and 80. Thus, the axis of rotation of die roller 33 is fixed by the specific structure of first upper frame member 27 and bearing support element 76 which is rigidly secured to first upper support element 27. Accordingly, it will be recognized by those skilled in these arts that all adjustments as to axis parallelism are made with the axis of die roller 33 bearing the fixed reference axis and the axis of base roller 32 being the adjustable axis.

Transverse registration between base roller 32 and die roller 33 is achieved by establishing base roller 32 as the fixed reference axis and die roller 33 as the transversely adjustable axis. Thus, whereas base roller 32 is transversely fixed in apparatus 10, die roller 33 is subject to transverse (axial) adjustment through the use of an axial displacement mechanism designated generally by the reference numeral 88 in FIG. 2.

Mechanism 88 includes a housing 89, a threaded shaft 90 and associated locking nuts 91 and 92. Housing 89 is a generally cylindrical member having one open end and an opposite end closed by a wall 93. Formed around the outer edge of housing 89 adjacent its open end is a radially outwardly extending flange 94. Flange 94 is provided with a plurality of axially extending bores which are aligned with tapped bores in first lower and upper frame members 25 and 26 to accommodate therethrough a plurality of bolts (not shown) for securing the housing to the frame members.

Formed in wall 93 is a throughbore 95 which is coaxial with the axis of rotation of die roller 33 and through which extends threaded shaft 90. Axial position of threaded shaft 90 within housing 89 is maintained and adjusted by the operation of locking nuts 91 and 92. Thus nuts 91 and 92 may be loosened, shaft 90 axially adjusted and the nuts tightened to secure the shaft in the newly adjusted position. In this regard it should be noted that access to nut 91 mounted within housing 89 may be achieved through an access opening 97 formed in the cylindrical wall of the housing 89.

As best may be seen in FIG. 2, the inner end of threaded shaft 90 is secured to shaft 84 of die roller 33 in such a manner as to cause the die roller 33 and shaft 90 to be axially displaceable together, but to permit rotation of die roller 33 independently of threaded shaft 90. Thus, there is rigidly secured to the end of shaft 84, such as by machine screws (not shown) an annular collar 99. Annular collar 99 cooperates with the end of shaft 84 to define a seat for the outer race of a bearing 100. The inner race of bearing 100 is received within an annular channel formed in the end of threaded shaft 90 by a washer and screw 101. In this regard it can be seen that the end of shaft 84 is provided with a slight counterbore to physically accommodate the assembly of the components and in particular to provide room for screw 101.

As will be evident to those skilled in these arts, axial displacement mechanism 88 provides a means for displacing die roller 33 along its axis of rotation without interfering with its ability to rotate. For example if it is desired to displace die roller 33 to the right as seen in FIG. 2, locking nut 92 may be loosened and locking nut 91 tightened. The tightening of locking nut 91 will cause displacement of threaded shaft 90 to the right and therewith die roller 33. Upon achieving the desired degree of movement, locking nut 92 is retightened to firmly position the shaft and die roller in position.

Referring now to FIG. 4 which is a cross-sectional elevational view of the apparatus, which view is similar to the view of FIG. 3, it can be seen that the second frame and its associated elements is substantially identical to but opposite hand the structure of the first frame.

Thus, as noted above, the second frame includes a second lower frame member 26 mounted in base 23 and a second upper frame member 28 mounted on and secured to the second lower frame member. Secured to the upper end of second frame member 28 are transversely extending parallel support bars 29 and 30. As noted above, support bars 29 and 30 cooperate with frame members 25, 26, 27 and 28 as well as with base 23 to define a rigid support structure for the operating elements of apparatus 10.

Referring therefore to FIG. 4, it can be seen that second lower frame member 26 is a generally U-shaped member having a generally vertically extending channel 103 formed therein. Channel 103 has a base surface 104 and opposed side surfaces 105, 106 formed therein. The side surfaces extend upwardly from base surface 104 through the remaining height of second lower frame member 26.

Rigidly secured to and supported on base surface 104 of channel 103 is a fluid motor 108 having a vertically extensible piston 109 extending reciprocably therefrom. In the embodiment shown, piston 109, similar to 41, is displaceable through a distance "A" (FIG. 4) to engage and exert an upwardly directed force upon the apparatus supporting an end 110 of the shaft of base roller 32. Similarly to fluid motor 40, fluid motor 108 may be a hydraulic motor selected from among many generally known and available in the art.

The outer surface 112 of second lower frame member 26 is relieved adjacent side surfaces 105 and 106 to define a pair of generally vertically extending channels 114 and 115. Rigidly secured within channel 114 and 115 such as by machine screws cooperating with tapped bores are a pair of track elements 116, 117 respectively. Track elements 116, 117 cooperate to define a pad for the controlled vertical displacement of apparatus which supports shaft 110.

Thus, shaft 110 is rotatably supported within a bearing housing 120. More specifically, bearing housing 120 comprises a generally rectangular member which is disposed within channel 103 which extends between side surfaces 114 and 115. The outer side edges of housing 120 are relieved to define vertically extending channels 121 and 122 such that track elements 116 and 117 are slidably received therein. Further, the upper end of lower outer corners of housing 120 are relieved adjacent channels 121 and 122 to permit the recess mounting therein of cam bearings 123, 124, 125 and 126. The surfaces of cam bearings 123 and 124 engage the inner edge of track element 116. Similarly, the surfaces of cam bearings 125 and 126 engage the inner edge of track element 117. The utilization of cam bearings 123, 124, 125 and 126 in cooperation with their respective track elements permits the transverse positioning of housing 120 within channel 103 and therewith, of course, shaft 110.

Extending through housing 120 is a bore 130 in which is received a bearing 131. The outer race of bearing 131 is rigidly positioned in housing 120 at bore 130 and the inner race of bearing 131 is rigidly secured to shaft 110 for rotation therewith.

As best may be seen in FIG. 4, there is rigidly secured to the upper surface of housing 120 a spacer plate 133. Spacer plate 133 is utilized to provide a rough positioning between the axes of rollers 32 and 33 and may be selected from a group of spacers which may be sized based upon the desired axial relationship of the rollers.

Figure 6:
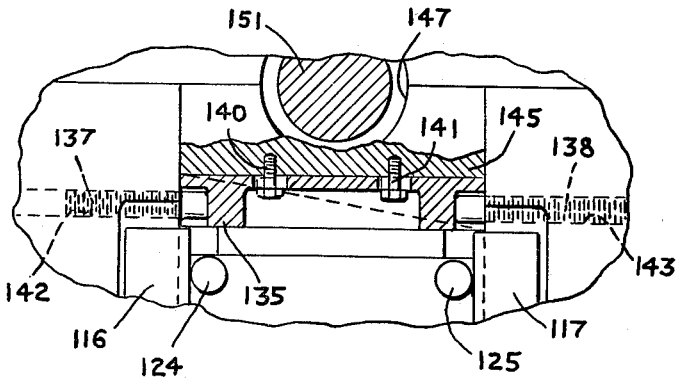
FIG. 6 is a partial view, partly in section, showing the construction of parallelism adjustment means according to the invention.
Figure 7:
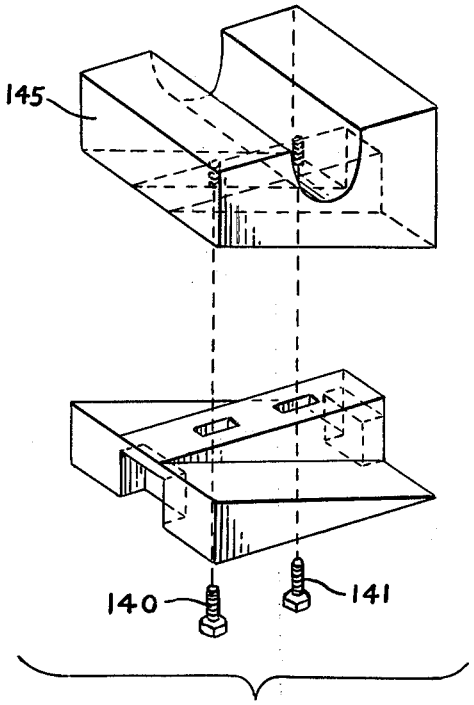
FIG. 7 is an isometric view of the wedge means utilized in the parallelism adjustment means according to the invention.

The upper surface of spacer plate 133 is adapted to engage the lower surface of a wedge element 135. Wedge element 135 is displaceable transversely through the operation of a pair of opposed elongated screws 137 and 138. More specifically, and referring to FIGS. 6 and 7, wedge element 135 is provided with transversely extending slots in which may be slidably mounted a pair of securing machine screws 140, 141. Loosening of screws 140 and 141 permit transverse displacement of wedge element 135 by the operation of opposed elongated screws 137 and 138. More specifically, screws 137 and 138 are threadedly received within tapped bores 142, 143 which are provided in bearing support element 145 on second lower frame member 26. Each of screws 137 and 138 is provided with an operating handle, the rotation of which causes rotation of the screws. Thus, cooperative operation of screws 137 and 138 are maintained in abutting relationship with the outer surface of wedge element 135. Thus, wedge element 135 may be displaced transversely to adjust the position of base roller 32 with respect to die roller 33.

It should be noted that the above described structure relating to the cooperation of wedge element 135 and bearing support element 145 is descriptive in all respects of the structural relationship between corresponding wedge element 67 and bearing support element 76 which are provided in cooperation with corresponding lower structural support components 25.

The upper surface of wedge element 135 is shaped to define surfaces 143 which are disposed at an angle which corresponds to the angle formed on the lower surface 144 of bearing support element 145. More specifically, there is provided at the upper end of channel 103 and extending between side surfaces 114 and 115, a bearing support element 145 which is rigidly secured to the second upper frame member 28 such as by machine screws (not shown).

Formed in the upper surface of bearing support element 145 is a semi-circular channel 147. Channel 147 cooperates with a semi-circular channel 148 formed in the lower surface of second upper frame member 28 to define a bore within which to receive a bearing 150. The inner race of bearing 150 is rigidly secured to a shaft 151 of die roller 33, e.g. by a lock nut 152.

The outer race of bearing 150 is slidably received within bore 148. Thus, the axis or rotation of die roller 33 is fixed at its end adjacent shaft 151 by the specific structure second upper frame member 28 and bearing support element 145.

As noted above, the outer race of bearing 150 is slidably received within bore 148 and as such shaft 151 is transversely slidable within bore 148 during transverse adjustment of die roller 33 as discussed above in detail.

Figure 5:
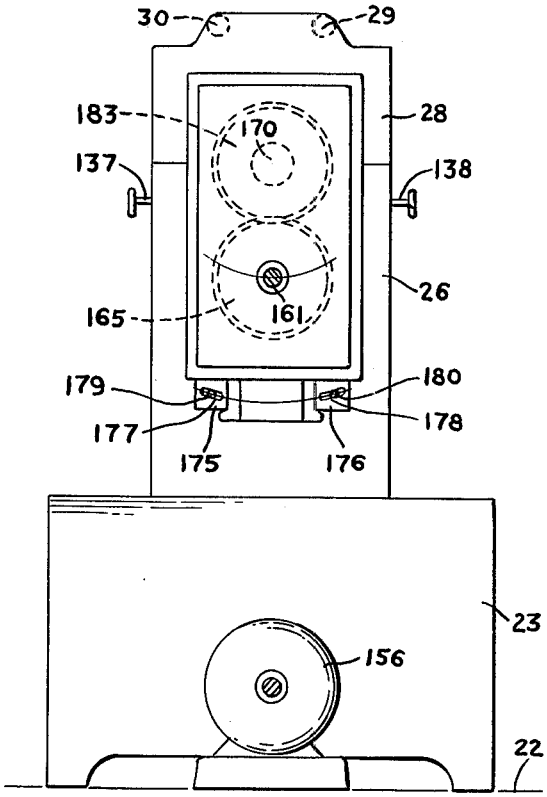
FIG. 5 is a side elevational view, partly in section, through the plane 5—5 of FIG. 2.

As stated above initially, it is the object of the present invention to provide for fine adjustments in rotary or running registration even during the operation of the apparatus. Description of the structure of the present invention which permits this functional capability is best made with reference to FIGS. 2 and 5. In this regard, particular emphasis is to be placed upon the driving mechanism for rollers 32 and 33 in that the rotary registration is achieved through adjustment of the respective drive means. Referring therefore to FIGS. 2 and 5 there is shown a motor 156 suitably mounted on floor 22 and having an output shaft 157. Mounted on output shaft 157 is a sheave 158 which imparts rotational motion from shaft 157 to a belt 159. Belt 159 is passed around sleave 158 as well as a sheave 160 which is rigidly mounted on a system drive shaft 161. System drive shaft 161 is rotatably supported with respect to rotatable housing 163 by a shaft bearing 164. Thus, the external end of shaft 161 has sheave 160 mounted thereon and the internal end of shaft 161 has mounted thereon drive gear 165 as well as the drive end 166 of a Schmidt coupling designated generally by the reference numeral 167. Rotatable housing 163 is rotatably supported by bearings 169 on a shaft 170. More specifically, shaft 70 is coupled to shaft 151 of die roller 33 by use of a split coupling 171. Shaft 170 is coaxial with shaft 151 and die roller 33 and rotates therewith.

Rotatable housing 163 is a generally rectangular member having a cylindrical housing 172 formed on the rear wall 173 thereof. The inner surface of cylindrical housing 172 rigidly received the outer race of bearing 169. The inner race of bearing 169 is secured to the external surface of shaft 170. Thus, notwithstanding any rotation of die roller 33, shaft 151 and shaft 170, independent rotation of rotatable housing 163 is possible.

Rigidly secured to the lower edge of rearward wall of 173 of rotatable housing 163 are first and second securing tabs 175, 176. Tabs 175 and 176 are rigidly secured to rotatable housing 163, e.g. by machine screws (not shown). Formed through each of tabs 175 and 176 and slots 177 and 178 which are curved to define an arc the radius of which is the distance from the center of the slot to the center of shaft 170. Thus, rotatable housing 163 is free to rotate about a center defined by the axis of rotation of shaft 170 and may be secured in any plurality of arcuate positions by providing a machine screw or other suitable securing means 179 180 through slots 177 and 178 in tabs 175 and 176 respectively into suitable tapped bores which are formed in a rigid support member 181 rigidly secured to second lower frame member 26 by suitable securing means such as bolts or the like.

Rigidly secured to the end of shaft 170 opposite the end which is secured to coupling 171 is a driven gear 183. Gear 183 is equal in equivalent diameter to drive gear 165 such that the rotation of base roller 32 and die roller 33 will be equal in angular velocity but opposition in direction.

As best may be seen in FIG. 2, there is provided in rear wall 173 of rotatable housing 163 a throughbore 185 which is coaxial with the axis of rotation of system drive shaft 161. Throughbore 185 accommodates the mounting therein of a bearing 186 which rotatably received the first drive ring 166 of Schmidt coupling 167. The driven end 188 of Schmidt coupling 167 is rigidly secured to shaft 110 of base roller 32. Thus rotation imparted to system drive shaft 161 through belt 159 and sheaves 158, 160 from motor 156 and its output drive shaft 157 is passed through Schmidt coupling 167 to base roller 32 by way of shaft 110. Similarly, such rotation is imparted to shaft 151 of die roller 33 through coupling 171, shaft 170, driven gear 183 and drive gear 165 respectively.

In order to adjust the rotary registration of base roller 32 with respect to die roller 33, machine screws 179 and 180 are loosened and rotatable housing 163 is rotated in a desired direction about shaft 170. Because the axes of rotation of rollers 33 and 32 are fixed by the positioning of their respective shafts 42, 84, 151 and 110, rotation of housing 163 causes a relative angular displacement of gears 165, 183 which is passed through Schmidt coupling 167 thereby causing a relative rotation of roller 32 with respect to roller 33. Upon achieving the desired adjustment in the rotary registration through the rotation of rotatable housing 163, machine screws 179 and 188 are tightened whereby to maintain the desired registration.

Considering now the operation of apparatus 10, it is first determined what size rollers 32 and 33 are to be utilized for a particular operation. Based upon the size of rollers 32 and 33 and therewith the desired degree of displacement of the axes and rotation of the two rollers, spacer plates 65 and 133 are selected to as to provide the rough positioning of the axes of the two devices. With spacer plates 65 and 133 positioned on bearing housing 50 and 120, respectively, fluid motors 40 and 108 are activated to cause pistons 41 and 109 to be displaced upwardly thereby engaging the lower surfaces of bearing housings 50 and 102 causing the housings to be displaced upwardly until the upper surfaces of spacer plates 65 and 133 contact the lower surfaces of wedge elements 75 and 135, respectively.

At this point the degree of displacement between the surfaces of rollers 32 and 33 may be measured to determine whether the spacing is correct and the axes of the respective rollers are parallel. In this regard dial indicator means (not shown) may be provided to give quick readings as to the relative spacing of the axes. However, the use of such dial indicators is not critical and any known method of measurement may be utilized.

Any disparity in the spacing between the surfaces of rollers 32 and 33 may be corrected by the adjustment of wedge elements 67 and 135 through the use of screw 68, 69 and 137 and 138 as discussed above in detail. Thus, rough adjustment of the parallelism of the axes of rollers 32 and 33 is achieved through the use of spacer plates 65 and 133 whereas fine adjustment through a high degree of accuracy is achieved through the use of wedge elements 67 and 135.

With the axis parallelism so established, transverse positioning of the rollers may be achieved by operation of axial displacement mechanism 88 as discussed above.

Upon the completion of the transverse and paralleling adjustment of the rollers 32 and 33, rotary registry may be achieved by adjustment of rotatable housing 163 as discussed above. With all registries acceptable, work stock may be inserted into the apparatus and operation commenced in the usual manner.

During operation of apparatus 10, fluid motors 40 are maintained active so as to maintain pistons 41 extended in the upward position whereby to exert upon bearing housings 50 and 120 an upwardly directed force which tends to hold base roller 32 in position. Thus, the fluid motors are sized such as to create a compressive force on bearing housings 50 and 120 such as to overcome any load forces which are generated during the operation of the apparatus. In this manner no loads in the equipment are such as to cause displacement of base roller 32 downwardly from die roller 33 whereby to cause, again, a misregistration of the respective rollers.

Still further, base roller 32 may be supported such as to be displaceable by the fluid motors between operating and retracted positions.

It can be seen therefore that the present invention provides a die roller apparatus wherein axial alignment and rotary alignment is achieved. Further, transverse alignment of the rollers is achieveable through the disclosed structure. It should be noted that fine adjustment in a transverse manner of a die sheet mounted on the rollers may be made through the use of die sheets secured to the respective rollers in the manner disclosed in my co-pending application Ser. No. 860,691.

Specific components of apparatus 10 may be manufactured using known materials and component elements which are generally available from manufacturers as are well known to those having skill in these arts.

Manufacturing techniques as well as assembly techniques are all well known and need not be described in detail.

Thus, it can be seen that the apparatus according to the present invention provides a die cutting apparatus which permits operation at production line speeds, which provides for adjustments without the necessity for disassembly of the apparatus and without the utilization of a plurality of gears as heretofore known, provides for adjustment even during operation of the apparatus and provides for find adjustment in terms of axis parallelism, rotary registration and transverse alignment. All of this is achieved through a relatively economical apparatus which is simple to construct and simple to operate.

It will be recognized by those skilled in the arts that many modifications and variations to the structure of the preferred embodiment disclosed may be made without departing from the spirit and scope of the invention.

I claim:

1. Apparatus for performing a manufacturing operation on a work piece comprising:

a first roller rotatably mounted in a support means;

a second roller rotatably mounted in a support means;

means for imparting rotation to said first roller and said second roller, said means for imparting rotation to said first roller and said second roller including a first drive element for imparting rotation to said first roller, a second drive element for imparting rotation to said second roller and means for imparting rotation to said first and second drive elements, and wherein the axis of rotation of said second drive element is displaced from the axis of rotation of said second roller;

means for connecting said second drive element to said second roller for transmitting rotation from said second drive element to said second roller; and means for mounting said second drive element such that the axis of rotation of said second drive element is displaceable along an arc the center of which is the axis of rotation of said first drive element, whereby displacement of the axis of rotation of said second drive element causes relative rotation of said second roller with respect to said first roller.

2. Apparatus according to claim 1 wherein said means for connecting said second drive element to said second roller and for imparting rotation from said second drive element to said second roller constitutes a direct drive means.

3. Apparatus according to claim 1 wherein said first drive element is mounted on a shaft which is rigidly connected to said first roller, and including a housing rotatably mounted on said shaft and wherein said second drive element is rotatably mounted on said housing.

4. Apparatus according to claim 1 including means for displacing said second roller between operating and retracted positions.

5. Apparatus according to claim 4 wherein said means for displacing said second roller comprises fluid motor means.

6. Apparatus according to claim 4 wherein said means for displacing said second roller comprises means for exerting forces against said second roller for resisting displacement of said second roller out of operating position during operation.

* * * * *